US008549889B2

(12) United States Patent
Morales

(10) Patent No.: US 8,549,889 B2
(45) Date of Patent: Oct. 8, 2013

(54) METAL FORMING PROCESS

(75) Inventor: Arianna T. Morales, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 360 days.

(21) Appl. No.: 12/942,964

(22) Filed: Nov. 9, 2010

(65) Prior Publication Data

US 2012/0111078 A1 May 10, 2012

(51) Int. Cl.
*B21D 37/16* (2006.01)
*C10M 169/00* (2006.01)

(52) U.S. Cl.
USPC ..... 72/42; 72/46; 72/342.2; 72/342.8; 508/155

(58) Field of Classification Search
USPC ..... 72/41–43, 46, 47, 342.2, 342.7, 342.8; 508/155
See application file for complete search history.

(56) References Cited

U.S. PATENT DOCUMENTS

| | | | | | |
|---|---|---|---|---|---|
| 2,294,828 | A | * | 9/1942 | Boyd et al. | 65/21.5 |
| 2,731,145 | A | * | 1/1956 | Kritscher | 72/42 |
| 2,901,380 | A | | 8/1959 | Crump | |
| 3,546,909 | A | | 12/1970 | Gartrell | |
| 3,927,460 | A | | 12/1975 | Harada et al. | |
| 3,934,441 | A | * | 1/1976 | Hamilton et al. | 72/60 |
| 4,096,076 | A | | 6/1978 | Spiegelberg | |
| 4,154,075 | A | | 5/1979 | Spiegelberg | |
| 4,269,053 | A | * | 5/1981 | Agrawal et al. | 72/42 |
| 4,281,528 | A | | 8/1981 | Spiegelberg et al. | |
| 6,745,604 | B1 | * | 6/2004 | Morales | 72/60 |
| 2005/0236078 | A1 | | 10/2005 | Murakami et al. | |

* cited by examiner

*Primary Examiner* — Dana Ross
*Assistant Examiner* — Pradeep C Battula
(74) *Attorney, Agent, or Firm* — Dierker & Associates, P.C.

(57) ABSTRACT

A metal forming process involves applying a lubricant, formed from a vitreous enamel mixed with particles of boron nitride, to at least one surface of a sheet metal blank, and without pre-heating the sheet metal blank, placing the sheet metal blank having the lubricant applied to the surface(s) thereof into a pre-heated forming tool so that the at least one surface contacts a surface of the forming tool. The method further involves, via the pre-heated forming tool, forming the sheet metal blank into a desired part shape, and during such forming, forming a lubricant layer on the surface(s) as the lubricant is heated from the pre-heated forming tool, the lubricant layer adhering to the surface(s) of the sheet metal blank.

11 Claims, 1 Drawing Sheet

METAL FORMING PROCESS

TECHNICAL FIELD

The present disclosure relates generally to metal forming processes.

BACKGROUND

Automotive body panels and other similar articles of manufacture are often made by forming a sheet metal blank using a forming press. During the forming process, the sheet metal blank is pressed against the surface of at least one die in the forming press. After a predetermined amount of forming time, the sheet metal blank assumes the shape of the die surface, and is thereafter removed from the forming press. In some instances, a lubricant may be applied to the die and/or the sheet metal blank to reduce adhesion between the two during the forming process, as well as to facilitate removal of the formed part from the forming press.

SUMMARY

As disclosed herein, a metal forming process includes applying a lubricant to at least one surface of a sheet metal blank, where the lubricant is formed from a vitreous enamel mixed with particles of boron nitride. The method further includes, without pre-heating the sheet metal blank, placing the sheet metal blank having the lubricant applied thereto into a pre-heated forming tool, and via the pre-heated forming tool, forming the sheet metal blank into a desired part shape. During the forming of the sheet metal blank into the desired part shape, a lubricant layer is formed on the surface as the lubricant is heated from the pre-heated forming tool, the lubricant layer adhering to the surface of the sheet metal blank.

BRIEF DESCRIPTION OF THE DRAWINGS

Features and advantages of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

FIGS. 1A through 1D schematically depict a metal forming process according to an example disclosed herein; and FIGS. 1A through 1E schematically depict a metal forming process according to another example disclosed herein.

DETAILED DESCRIPTION

Figures 1A, 1B, 1C, 1D, 1E:
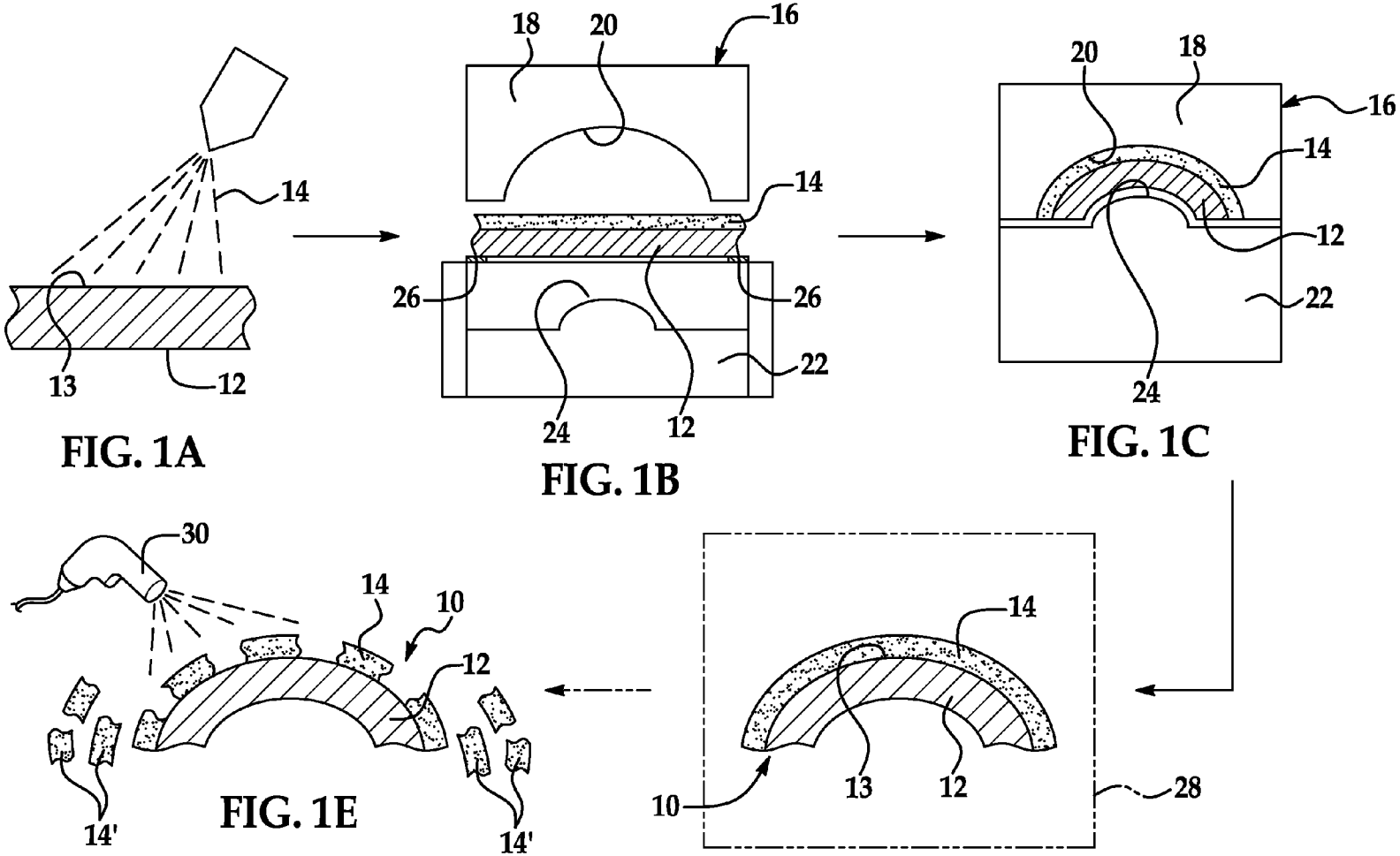

Example(s) of the metal forming process as disclosed herein include a forming process that uses a lubricant that, when applied to a surface of a sheet metal blank, advantageously reduces or even prevents adhesion of the blank to the forming tool. In an example, the adhesion (in terms of its coefficient of friction) is reduced by at least 40% compared with other lubricants containing enamels without boron nitride. The lubricant utilized in the process may be formed from a composite of boron nitride and a vitreous enamel, and is configured to adhere to the sheet metal blank throughout the forming process. The lubricant is further configured to automatically break apart upon cooling after the blank, which has been formed into an article or part, is removed from the forming tool. The breaking apart of the lubricant advantageously obviates a need for post-forming washing or other cleaning process(es) that are typically used to remove lubricant from the formed part. The eliminating of such post-forming processes may, in some instances, render the forming method disclosed herein as efficient at least in terms of time, maintenance, and/or material/equipment costs.

The example(s) of the metal forming process disclosed herein are generally used to form a part having a desired part shape from a sheet metal blank, where the forming is accomplished via hot forming using a forming press or tool. As used herein, "hot forming" refers to the superplastic deformation of the sheet metal blank when the blank is pressed against one or more surfaces of the forming tool under temperatures ranging from about 400° C. to about 1200° C. It is to be understood that a temperature falling within this range may be referred to herein as a "hot temperature".

Further, the example(s) of the metal forming process may be used to form sheet metal composed of any sheet metal material known in the art, some non-limiting examples of which include steel, iron, magnesium, aluminum, alloys of magnesium or aluminum, and/or the like, and/or combinations thereof. It is to be understood that the metal forming process of the instant disclosure is particularly useful for sheet metals that are composed of a material that tends to readily adhere to the tool during forming. When such materials are used, the adherence of the material to the tool often leads to the formation of surface defects of the formed part, which may, in some cases, be undesirable. Some non-limiting examples of sheet metal materials exhibiting this adhesive property include, but are not limited to, aluminum, magnesium, titanium, and alloys of each.

The adherence of the sheet metal blank to one or more contacting surfaces of the forming tool may be reduced, for example, by applying the lubricant to the contacting surfaces of the forming tool or to the sheet metal blank itself. In many cases, the lubricant is applied to the sheet metal blank prior to placing the blank inside the forming tool. Several lubricants are commercially available and may suitably be used to reduce the adhesion issue between the sheet metal blank and the forming tool, non-limiting examples of which include mixtures of graphite and boron nitride. The lubricant films obtained from these mixtures, however, have a tendency to break down or otherwise lose their lubricity in certain high stress areas of the sheet metal blank (e.g., at corners, bends, etc.), which causes the sheet metal to stick to the forming tool at/around those high stress areas. In many cases, the quality of the formed part or article is greatly reduced, at least in those high stress areas, and the breaking down of the lubricant during the forming may affect or otherwise compromise the working life of the forming tool itself. Yet further, the cost of pure graphite or of pure boron nitride may be such that it may be economically disadvantageous to use mixtures of these materials in quantities necessary to effectively reduce the adhesion.

An example of a lubricant that may effectively be used in the examples of the method disclosed herein includes one formed from particles of boron nitride and a vitreous enamel. Without being bound to any theory, it is believed that the boron nitride contributes to decreasing the coefficient of friction between the sheet metal blank and the forming tool in the presence of hot temperatures. This allows the metal to flow into surfaces of the tool so that a part may be formed without, or with minimal surface defects. Further, the vitreous enamel melts at working temperatures, and thus the lubricant film may be transformed into a plastic layer that covers substantially the entire working surface of the sheet metal blank. For at least this reason, there is minimal contact, if any, between the tool and the sheet metal surface.

In an example, the boron nitride particles have an average particle size (measured in terms of, e.g., the particles' effective diameter) ranging from about 7 microns to about 10 microns, and at least 90% of the boron nitride particles have a particle size that is smaller than 15 microns. For instance, if about 90% of the boron nitride particles have a particle size of less than 10 microns, then i) about 50% of the boron nitride particles are smaller than 5 microns, and ii) about 10% of the boron nitride particles are smaller than 1.5 microns. The boron nitride particles may be commercially available from, e.g., Atlantic Equipment Engineers, Bergenfield, N.J.; Kadco Ceramics, Easton, Pa.; Goodfellow Corp., Oakdale, Pa.; and AC Technologies, Yonkers, N.Y., to name a few.

In an example, the vitreous enamel is a porcelain enamel formed from a borosilicate glass prepared from a combination of some or all of the following materials: quartz ($SiO_2$), borax (anhydrous formula $Na_2B_4O_7$), boric acid ($H_3BO_3$), potassium nitrate ($KNO_3$), sodium silicofluoride ($Na_2SiF_6$), and manganese dioxide ($MnO_2$). The enamel may further include titanium dioxide ($TiO_2$), antimony oxide ($Sb_2O_3$), cobalt oxide (such as, e.g., cobaltous oxide (CoO), cobalto-cobaltic oxide ($CO_3O_4$), cobaltic oxide ($CO_2O_3$), barium oxide (BaO), sodium oxide ($Na_2O$), potassium oxide ($K_2O$), lead (II) oxide (PbO), boron trioxide ($B_2O_3$), and/or combinations thereof. The proportions of the materials used in a mixture of selected materials from the foregoing examples to form the enamel may be adjusted depending, at least in part, on the temperature at which the part is formed and the performance characteristics needed from the lubricant. One specific example of the vitreous enamel includes a dry mix of about 33 wt % $Na_2O$, about 22 wt % $K_2O$, about 3 wt % of PbO, about 10 wt % of $B_2O_3$, about 12 wt % $TiO_2$, and about 20 wt % $SiO_2$, and water was added to the dry mix at a ratio of about 2:1 to make a slip of the enamel.

The lubricant includes about 10 wt % to about 20 wt % of the boron nitride, and about 80 wt % to about 90 wt % of the vitreous enamel. In an example, the lubricant has a melting temperature ranging from about 800° F. to about 1000° F., which falls within the hot forming temperature range.

In an example, the lubricant is generally made by mixing the boron nitride particles with the vitreous enamel and water to form a water-based slurry. Details of this process may be found in U.S. Pat. No. 6,745,604, owned by the Assignee of the instant application, the contents of which is incorporated herein by reference in its entirety.

Details of the metal forming process will now be described herein in conjunction with the figures. It is to be understood that the metal forming method is referred to herein as a continuous metal forming process (i.e., the sheet metal blank is not cooled or otherwise exposed to a temperature sufficient to cool the blank until after the part is formed). This is in contrast to discontinuous processes, whereby the sheet metal blank is cooled or exposed to a temperature sufficient to cool the blank more than once before the part is actually formed. For instance, the sheet metal blank may be placed inside a preheating oven or furnace so that the lubricant adheres to the blank surface. The blank is then removed from the preheating oven and placed into the forming tool. Due, at least in part, to the thinness of the blank and its thermal expansion coefficient (which is higher than that of the lubricant) the blank cools relatively quickly during the time defined between the removing of the blank from the oven and the placing of the blank into the forming tool. In many cases, the enamel portion of the lubricant becomes brittle upon cooling when the blank is removed from the preheating oven. Accordingly, when the blank is placed into the forming tool and exposed to the hot forming temperature, the lubricant (now in a brittle state due at least in part to the brittleness of the enamel) detaches from the blank during the hot forming inside the forming tool.

Referring now to FIG. 1A, an example of the metal forming method includes applying the lubricant 14 to at least one surface (such as the surface 13 shown in FIG. 1A) of the sheet metal blank 12. In an example, the lubricant 14 may be applied to, for example, the surface 13 by spraying the lubricant in its liquid form onto the surface 13 using a spray gun or other suitable spraying device. The lubricant 14 may otherwise be applied using other methods known in the art, non-limiting examples of which include painting, dipping, immersing, roll depositing, and/or the like, and/or combinations thereof. In an example, lubricant 14 is applied to the entire surface 13, or is applied to a portion of the surface 13 in a manner sufficient for the lubricant 14 to flow across the entire surface 13. The amount of lubricant 14 applied is such that the lubricant can form a layer on the surface 13 having a thickness ranging from about 10 microns to about 20 microns, which will be described further below.

The sheet metal blank 12 having the lubricant 14 applied on the surface 13 thereof, and which is not preheated, may then be placed into a preheated forming tool (such as the forming tool 16 shown in FIG. 1B) so that the at least one surface contacts a surface of the forming tool 16. As described in more detail below, the enamel portion of the lubricant 14 layer becomes brittle and breaks off of the part 10 upon cooling. Thus, the blank 12 is not preheated (e.g., by placing the blank in an oven) prior to being placed into the forming tool 16 at least in part because when the blank is exposed to cooler temperatures (e.g., the ambient air when the blank is removed from the oven), the enamel portion of the lubricant 14 may start to break off. This is in contrast to other lubricants that are currently used that do not include a vitreous enamel, and thus these other lubricants may be preheated prior to being placed in a forming tool.

In an example, the forming tool 16 is preheated to a temperature ranging from about 800° F. to about 1200° F., which is i) within the hot forming temperature range, and ii) the melting temperature of the lubricant. It is to be understood that the blank may otherwise be placed into a non-preheated tool, and then the tool may be heated to the hot forming temperature range disclosed above. Thus, upon being placed inside the forming tool 16 and being exposed to the heat (either when the tool is preheated or heated after the blank is placed therein), the lubricant 14 melts and forms a lubricant 14 layer on the surface 13 of the blank 12. As mentioned above, this lubricant 14 layer covers the entire surface 13 of the blank 12 such that the blank 12 does not stick or adhere to the forming tool when in contact therewith. More specifically, the lubricant 14 acts like a separation layer between a forming tool 16 (such as a surface 20 of a die 18) and the surface 13 of the sheet metal blank 12. As will be described in further detail below, once the lubricant 14 layer is formed, the layer does not break. As such, the die surface 20 and the sheet metal surface 13 remain separate throughout the forming process.

Referring now to FIG. 1B, in an example, the forming tool (identified by reference numeral 16) is an apparatus that may be used for the hot forming process disclosed herein. This forming tool 16 actually forms the sheet metal blank 12 into any article of manufacture that may be formed via warm and/or hot forming processes. A non-limiting example of such an article includes an automotive body part. The article of manufacture may be referred to herein as an "article", a "formed part", or just simply a "part".

As shown in FIG. 1B, the forming tool 16 includes an upper die 18 having an upper die surface 20, and a lower die 22 having a lower die surface 24. The forming tool 16 may otherwise include an upper die 18 without a lower die 22, or a lower die 22 without an upper die 18 (not shown in the figures). While in a retracted position (as shown in FIG. 1B), the sheet metal blank 12 having the lubricant 14 applied thereon may be placed between the upper and lower dies 18, 22, and may be supported in the forming press 16 by a support member 26. The support member 26 may be a clamp, a bracket, or other suitable support means.

During hot forming, the temperature of the preheated forming tool 16 remains within the 800° F. to 1200° F. range (i.e., the temperature range at or above the melting temperature of the lubricant), and at least one of the upper die 18 or the lower die 22 is drawn toward the other of the dies 18, 22. This movement presses the supported sheet metal blank 12 against the surfaces 20, 24 of the dies 18, 22, respectively, in the presence of the heat.

After a predetermined period of pressing time, the sheet metal blank 12 assumes the shape of the die surfaces 20, 24 and forms the blank 12 into the desired part shape or article 10 (shown in FIGS. 1C and 1D). It is to be understood that the amount of pressing time depends, at least in part, on the forming process. In one non-limiting example, the predetermined amount of pressing time ranges from about one second to several minutes. Thereafter, the upper and lower dies 18, 22 are retracted from one another (or one of the dies 18, 22 is retracted from the other die 22, 18). The formed part may be released from the forming tool 16 and then removed without any part of the formed part sticking to the die 18 or the die 22. Since the formed part does not stick or adhere to the forming tool 16 during forming, the part may be removed without having to apply mechanical removing processes, including those that use chemical removal agents.

Upon removing the formed part 10 from the forming tool 16, the part 10 substantially immediately begins to cool down from the hot forming temperature of 800° F. to 1200° F. to (ultimately) ambient temperature. It is to be understood that the rate of cooling depends, at least in part, on the thickness of the part, as well as the heat conductivity of the material used to form the part (i.e., the material of the sheet metal blank 12). For those parts formed from aluminum or alloys thereof having a thickness of about 1 mm, cooling may be accomplished relatively quickly (e.g., in a matter of seconds such as about 30 to 40 seconds). Cooling may be accomplished simply by exposing the part 10 to the ambient environment. In some instances, cooling may also be accomplished by placing or otherwise exposing the part 10 to a cooling fixture 28 (shown schematically in phantom line in FIG. 1D) such as, e.g., placing the part 10 in a refrigerator or a cooling bath, and/or exposing the part 10 to a source of cold air such as a fan.

In response to the cooling of the part 10, the enamel portion of the lubricant 14 layer becomes brittle and breaks off of the part 10. Without being bound to any theory, it is believed that the brittleness of the enamel portion of the lubricant 14 occurs upon cooling, at least in part because the thermal expansion coefficient is significantly lower than that of the sheet metal used to form the part 10. More specifically, the higher thermal expansion coefficient of the sheet metal (such as for aluminum) causes the material to contract more than the enamel portion of the lubricant during cooling. This allows the sheet metal upon which the lubricant is applied to change shape more quickly than the enamel, and thus the enamel portion of the lubricant breaks apart. It is to be understood that this may also occur if the lubricant is applied, e.g., to the die surface 20 in instances where the die 18 is formed from a material (such as a ferrous material) that renders the difference between the thermal expansion coefficients of the lubricant and the die as being high. In some instances, the broken off pieces of the lubricant (which are identified by 14' in FIG. 1E) layer falls off the part 10 without using any post-processing cleaning technique such as, e.g., applying a washing agent and scrubbing the part 10 surface to remove any left over lubricant. It may be helpful, in some instances, to further clean off the part 10 surface to remove broken off pieces of the lubricant 14' that did not naturally fall off. This may be accomplished, for example, by air blowing the broken off pieces from the surface using an air blower 30 (which is semi-schematically shown in FIG. 1E). This cleaning step may be accomplished prior to subjecting the formed part 10 to any post-forming process (e.g., painting, etc.)

While several examples have been described in detail, it will be apparent to those skilled in the art that the disclosed examples may be modified. Therefore, the foregoing description is to be considered non-limiting.

The invention claimed is:

1. A metal forming process, comprising:

applying a lubricant to at least one surface of a sheet metal blank, the lubricant being formed from a vitreous enamel mixed with particles of boron nitride;

without pre-heating the sheet metal blank, placing the sheet metal blank including the lubricant applied to the at least one surface thereof into a pre-heated forming tool so that the at least one surface contacts a surface of the forming tool;

via the pre-heated forming tool, forming the sheet metal blank into a desired part shape;

during the forming of the sheet metal blank into the desired part shape, forming a lubricant layer on the at least one surface as the lubricant is heated from the pre-heated forming tool, the lubricant layer adhering to the at least one surface of the sheet metal blank;

removing the formed sheet metal blank from the pre-heated forming tool, the formed sheet metal blank having the lubricant layer formed on the at least one surface thereof; and cooling the formed sheet metal blank to ambient temperature;

wherein, during the cooling, the lubricant layer breaks off from the formed sheet metal blank.

2. The process as defined in claim 1 wherein the applying of the lubricant to the at least one surface of the sheet metal blank includes spraying the lubricant onto the at least one surface.

3. The process as defined in claim 1, further comprising pre-heating the pre-heated forming tool to a temperature ranging from about 800° F. to about 1200° F.

4. The process as defined in claim 1 wherein the cooling includes exposing the formed sheet metal blank to an ambient environment.

5. The process as defined in claim 4 wherein at least 90% of the particles of boron nitride have a particle size of 15 microns or less.

6. The process as defined in claim 1, further comprising cleaning the at least one surface of the sheet metal blank by air blowing the broken off pieces of the lubricant layer from the at least one surface.

7. The process as defined in claim 6 wherein the cleaning is accomplished prior to subjecting the formed sheet metal blank to a post-forming process.

8. The process as defined in claim 1 wherein the sheet metal blank is formed from a metal material selected from aluminum, aluminum alloys, magnesium, magnesium alloys, titanium, titanium alloys, and combinations thereof.

9. The process as defined in claim 1 wherein the vitreous enamel is formed from quartz ($SiO_2$), borax (anhydrous formula $Na_2B_4O_7$), boric acid ($H_3BO_3$), potassium nitrate ($KNO_3$), sodium silicofluoride ($Na_2SiF_6$), manganese dioxide ($MnO_2$), and combinations thereof.

10. The process as defined in claim 1 wherein the particles of boron nitride have an average particle size ranging from about 7 microns to about 10 microns.

11. The process as defined in claim 1 wherein the lubricant has a melting temperature ranging from about 800° F. to about 1200° F.

* * * * *